US012607034B2

(12) United States Patent
Park et al.

(10) Patent No.: US 12,607,034 B2
(45) Date of Patent: Apr. 21, 2026

(54) ROOFTOP TENT

(71) Applicant: IKAMPER CO., LTD., Paju-si (KR)

(72) Inventors: Soon Gyu Park, Seoul (KR); Seung Suk Ha, Paju-si (KR); Wan Cheol Shin, Paju-si (KR)

(73) Assignee: IKAMPER CO., LTD., Paju-si (KR)

( * ) Notice: Subject to any disclaimer, the term of this patent is extended or adjusted under 35 U.S.C. 154(b) by 587 days.

(21) Appl. No.: 17/999,595

(22) PCT Filed: Oct. 18, 2022

(86) PCT No.: PCT/KR2022/015868

§ 371 (c)(1),
(2) Date: Feb. 8, 2024

(87) PCT Pub. No.: WO2023/068761

PCT Pub. Date: Apr. 27, 2023

(65) Prior Publication Data

US 2024/0287829 A1 Aug. 29, 2024

(30) Foreign Application Priority Data

Oct. 22, 2021 (KR) ..... 10-2021-0141468

(51) Int. Cl.
*E04H 15/06* (2006.01)
*E04H 15/58* (2006.01)
*E04H 15/64* (2006.01)

(52) U.S. Cl.
CPC ..... *E04H 15/06* (2013.01); *E04H 15/58* (2013.01); *E04H 15/64* (2013.01)

(58) Field of Classification Search
CPC ..... E04H 15/06; E04H 15/58; E04H 15/64; E04H 15/32; E04H 15/44; B60P 3/34
See application file for complete search history.

(56) References Cited

U.S. PATENT DOCUMENTS 742,246 A * 10/1903 Sorensen ..... E04F 10/10 135/117
1,546,613 A * 7/1925 Beman ..... E04H 15/32 135/117

(Continued)

FOREIGN PATENT DOCUMENTS

KR 850010160 U 12/1985
KR 200246490 Y1 10/2001

(Continued)

OTHER PUBLICATIONS

PDF of Google Patents translation of KR 20-0246490 (Year: 2001).*

(Continued)

*Primary Examiner* — Robert Canfield
(74) *Attorney, Agent, or Firm* — Maier & Maier, PLLC

(57) ABSTRACT

The present disclosure relates to a rooftop tent. A rooftop tent according to an embodiment of the present disclosure includes a rooftop tent main body including a tent member configured to be folded on a roof of a vehicle and stand when being unfolded toward a lateral side of the vehicle, a rotary canopy rotatably connected to the tent member, and a controller connected to the tent member and the rotary canopy and configured to fold the rotary canopy upward so that portions of the rotary canopy overlap one another.

11 Claims, 11 Drawing Sheets

(56) References Cited

U.S. PATENT DOCUMENTS 1,560,114 A * 11/1925 Skog ..... E04H 15/64 135/117
1,583,832 A * 5/1926 Hoigaard ..... E04H 15/32 135/117
1,888,014 A * 11/1932 Powers ..... E04H 15/32 135/117
2,516,869 A * 8/1950 Harris ..... E04H 15/44 D21/834
2,666,441 A * 1/1954 Powers ..... E04H 15/32 135/117
2,857,924 A * 10/1958 Gibbons ..... B60P 3/38 135/117
3,073,326 A * 1/1963 Lefebvre ..... E04H 15/06 135/93
3,746,386 A * 7/1973 Woodward ..... B60P 3/38 296/159
4,058,133 A * 11/1977 Barr ..... B60P 3/38 135/132
4,066,089 A * 1/1978 Rainwater ..... E04H 15/48 135/117
5,111,866 A * 5/1992 Prostko ..... E06B 9/58 160/90
5,193,602 A * 3/1993 Morales ..... E06B 9/521 160/243
7,677,260 B2 * 3/2010 Sumner ..... E04H 15/32 135/117
7,789,098 B2 * 9/2010 Livacich ..... E04H 15/64 135/147
8,776,814 B1 * 7/2014 Beam ..... E04H 15/44 135/117
9,719,296 B1 * 8/2017 Lynch ..... E06B 9/262
11,578,499 B2 * 2/2023 Currid ..... B60R 9/045
12,091,874 B2 * 9/2024 Payne ..... E04H 15/64
12,312,824 B2 * 5/2025 Lafoux ..... E04H 15/54
12,312,827 B2 * 5/2025 Otis ..... E06B 9/063
2005/0045284 A1 * 3/2005 Ullyett ..... E06B 9/78 160/238
2005/0120640 A1 * 6/2005 Cantwell ..... E04H 15/14 52/79.1
2005/0194033 A1 * 9/2005 Holub ..... E04H 15/32 135/156
2005/0199356 A1 * 9/2005 Nien ..... E06B 9/262 160/348
2014/0202512 A1 * 7/2014 Jin ..... E04H 15/46 135/139
2016/0289996 A1 * 10/2016 Kendrick ..... E04H 15/34
2018/0106070 A1 * 4/2018 Chen ..... E06B 9/0692
2018/0195310 A1 * 7/2018 Rathbun ..... E04H 15/58
2020/0087912 A1 * 3/2020 Konings ..... E04B 1/342
2022/0098893 A1 * 3/2022 Chen ..... B60P 3/341
2022/0396967 A1 * 12/2022 Dunn ..... E04H 15/06
2023/0121447 A1 * 4/2023 Lafoux ..... E04H 15/34 135/88.07
2023/0151685 A1 * 5/2023 Park ..... E06B 9/38 160/84.03
2023/0250635 A1 * 8/2023 Mcgregor ..... E04B 2/7459 160/327
2025/0034899 A1 * 1/2025 May ..... E06C 1/125
2025/0283348 A1 * 9/2025 Otis ..... E06B 9/063

FOREIGN PATENT DOCUMENTS

KR 200382870 Y1 4/2005
KR 20210108220 A 9/2021

OTHER PUBLICATIONS

Search Report and Written Opinion issued on Jan. 20, 2023, in corresponding International Application No. PCT/KR2022/015868, 16 pages.

* cited by examiner

ROOFTOP TENT

CROSS REFERENCE TO RELATED APPLICATION

This application claims the benefits of South Korean Application No. 10-2021-0141468, filed on Oct. 22, 2021, the disclosure of which is incorporated herein by reference in its entirety.

BACKGROUND OF THE DISCLOSURE

Field of the Disclosure

The present disclosure relates to a rooftop tent.

Description of the Related Art

With the increase in income and the improvement of living conditions, there is an increasing number of people who intend to enjoy leisure activities such as travel, fishing, and camping. Because the leisure activities such as travel, fishing, and camping are mainly outdoor activities performed outdoors, there is a growing interest in tents that are outdoor products for rest and accommodation during outdoor activities.

Because the tent has various sizes but generally has a large volume, there is a problem in that the tent is difficult to carry, install, and dismantle. In particular, in case that a user intends to use the tent during outdoor activities such as travel, fishing, or camping, the user needs to load the tent into the vehicle and move the tent outdoors by using the vehicle. Furthermore, the user needs to take the tent out of the vehicle and then install the tent outdoors, there is a problem in that the manpower and time are required to install the tent.

In addition, because of a large volume of the tent, there is a problem in that it is difficult to load various preparations required for outdoor activities into the vehicle together with the tent. In addition, because a minimum flat ground surface needs to be ensured to stably install the tent, there is a problem in that there is a constraint in selecting a position for installing the tent.

Meanwhile, to solve the problems with the tent in the related art, Korean Patent Application Laid-Open No. 10-2021-0108220 discloses an expandable rooftop tent. The expandable rooftop tent disclosed in Korean Patent Application Laid-Open No. 10-2021-0108220 is loaded, in a folded state, at an upper end of a roof carrier installed on a roof of a vehicle and configured to stand when being unfolded toward a lateral side of the vehicle.

In this case, the expandable rooftop tent in the related art may have a window that may selectively block an internal space of the tent from the outside. A canopy may be provided above the window and rotate upward or downward. The canopy may rotate upward to serve to form a shade. The canopy, which has formed a shade by rotating upward, may rotate downward and return to an original position to serve as a curtain for the window.

Meanwhile, to improve the openness of the window, the canopy, which serves as the curtain of the window, needs to be folded upward. However, the expandable rooftop tent in the related art does not separately have a control means capable of folding the canopy upward. For this reason, the user needs to directly hold the canopy and fold the canopy upward.

Accordingly, there is a need for research on a rooftop tent capable of allowing the user to fold the canopy upward with a simple manipulation, thereby reducing the amount of manpower and time required to fold the canopy upward and improving the convenience of use.

SUMMARY OF THE DISCLOSURE

The embodiments of the present disclosure have been made in an effort to solve the above-mentioned problems in the related art, and an object of the present disclosure is to provide a rooftop tent capable of allowing a user to fold a canopy upward with a simple manipulation, thereby reducing the amount of manpower and time required to fold the canopy upward and improving the convenience of use.

One aspect of the present disclosure provides a rooftop tent including: a rooftop tent main body including a tent member configured to be folded on a roof of a vehicle and stand when being unfolded toward a lateral side of the vehicle; a rotary canopy rotatably connected to the tent member; and a controller connected to the tent member and the rotary canopy and configured to fold the rotary canopy upward so that portions of the rotary canopy overlap one another.

In addition, the rooftop tent may further include: a fastener configured to selectively fasten the rotary canopy to the tent member, in which the fastener includes: a first fastening means provided on any one of an outer surface of the tent member and an inner surface of the rotary canopy and extending in one direction; and a second fastening means provided on the other of the outer surface of the tent member and the inner surface of the rotary canopy and extending in one direction, and the second fastening means being configured to selectively engage with the first fastening means.

In addition, the controller may include: a control rope extending in one direction and having at least a part disposed at one side of any one of the first fastening means and the second fastening means; and a connection member disposed in a direction perpendicular to one direction and configured to connect at least a part of the control rope to any one of the first fastening means and the second fastening means, and the remaining part of the control rope may be exposed in the tent member.

In addition, the connection member may include: a movement insertion into which the control rope is movably inserted; a first fixing portion connected to one side of the movement insertion portion and fixed to an inner surface of the rotary canopy; and a second fixing portion connected to the other side of the movement insertion portion and fixed to the inner surface of the rotary canopy, and an end of any one of the first fixing portion and the second fixing portion may be connected to any one of the first fastening means and the second fastening means.

In addition, the controller may further include a stopper movably connected to the remaining part of the control rope exposed in the tent member.

In addition, the rotary canopy may have at least one rotary canopy side passageway extending in an upward/downward direction, and at least a part of the control rope may be movably disposed in the rotary canopy side passageway.

In addition, the tent member may have a through-hole through which the remaining part of the control rope passes.

In addition, the connection member may be provided as a plurality of connection members, and a width of the rotary canopy, which is disposed between two adjacent connection members among the plurality of connection members, may be changed by an external force applied to the control rope exposed in the tent member.

In addition, the stopper may include: an insertion body having an elastic member therein and having a first insertion hole into which the control rope is penetratively inserted; and a movement body movably coupled to the insertion body and having a second insertion hole configured to selectively communicate with the first insertion hole, the movement body being configured to selectively press the elastic member.

The rooftop tent may further include a fixed canopy connected to the tent member.

In addition, the rooftop tent may further include a reinforcing support part provided on the fixed canopy.

In addition, the reinforcing support part may include: a first fixing means provided on an inner surface of the fixed canopy; and a first reinforcing support member having one end fixed to at least one of the tent member and the fixed canopy, and the other end selectively inserted and accommodated in the first fixing means.

In addition, the reinforcing support part may further include: a second fixing means provided along at least a part of a periphery of the fixed canopy; a second reinforcing support member selectively inserted and fixed into the second fixing means; and a third fixing means provided on at least one of the tent member and the fixed canopy and configured such that an end of the second reinforcing support member is fixedly inserted into the third fixing mean.

The rooftop tent according to the embodiments of the present disclosure may allow the user to fold the canopy upward with a simple manipulation, thereby reducing the amount of manpower and time required to fold the canopy upward and improving the convenience of use.

DETAILED DESCRIPTION OF THE DISCLOSURE

Figure 1:
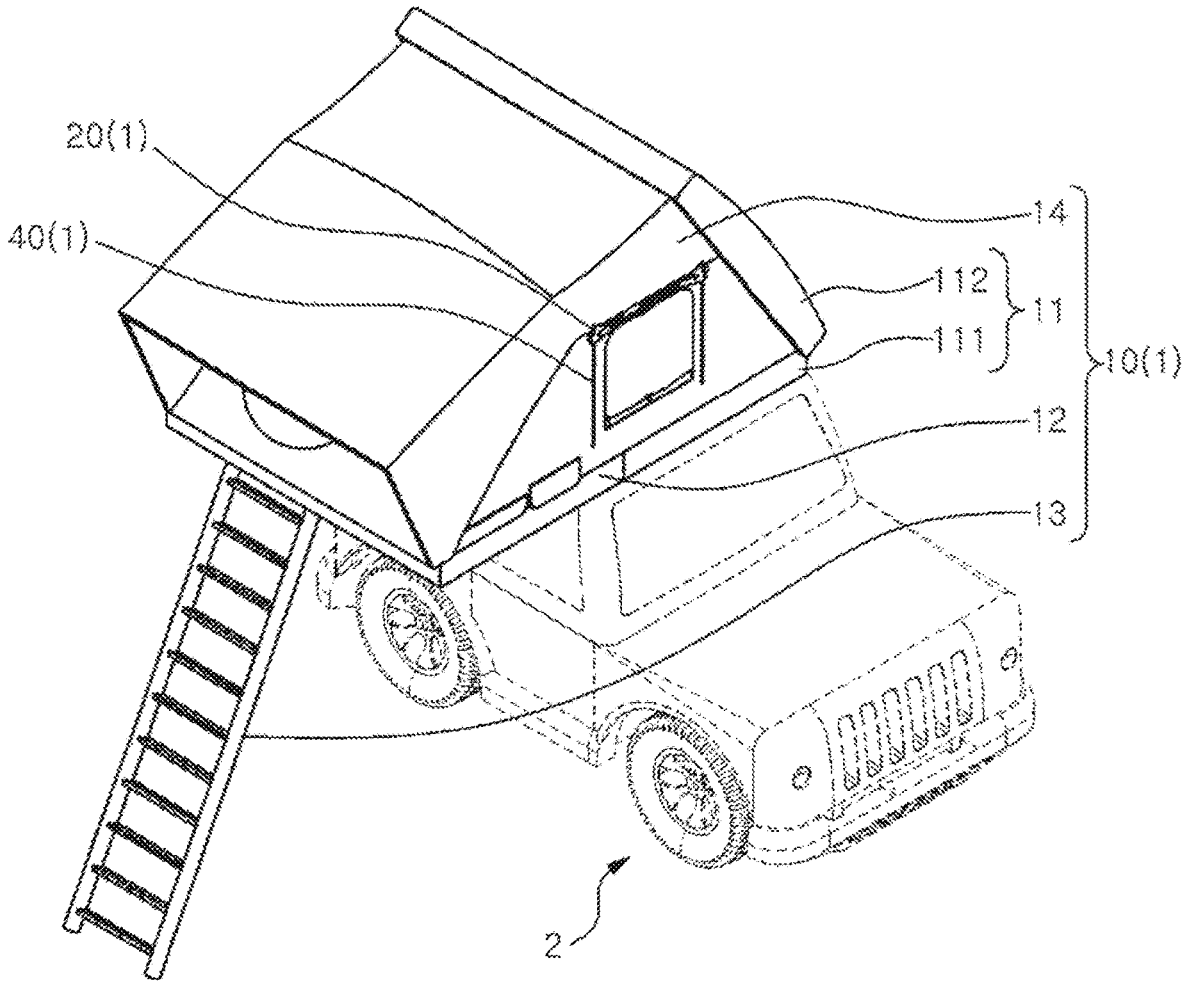
FIG. 1 is a perspective view illustrating a rooftop tent according to an embodiment of the present disclosure.

Hereinafter, specific embodiments for implementing the spirit of the present disclosure will be described in detail with reference to the drawings.

In addition, in the description of the present disclosure, the specific descriptions of publicly known related configurations or functions will be omitted when it is determined that the specific descriptions may obscure the subject matter of the present disclosure.

In addition, when one constituent element is described as being "coupled to," or "connected to" another constituent element, it should be understood that one constituent element can be coupled or connected directly to another constituent element, and an intervening constituent element can also be present between the constituent elements.

The terms used in the present specification are used only for the purpose of describing particular embodiments and are not intended to limit the present disclosure. Singular expressions include plural expressions unless clearly described as different meanings in the context.

In addition, it is noted in advance that in the present specification, the terms "one side," "the other side," "upper side," "lower side," and the like are explained based on the illustration in the drawings and may be differently expressed when the directions of the corresponding objects are changed.

For the same reason, some constituent elements in the accompanying drawings are illustrated in an exaggerated or schematic form or are omitted, and a size of each constituent element does not entirely reflect an actual size.

In addition, the terms including ordinal numbers such as "first," "second," and the like may be used to describe various constituent elements, but the constituent elements are not limited by the terms. These terms are used only to distinguish one constituent element from another constituent element.

The terms "comprises" and/or "comprising" used in the specification specify particular features, regions, integers, steps, operations, elements, and/or components, but do not exclude the presence or addition of other particular features, regions integers, steps, operations, elements, components, and/or groups thereof.

Hereinafter, a rooftop tent according to an embodiment of the present disclosure will be described with reference to the drawings.

Figure 2:
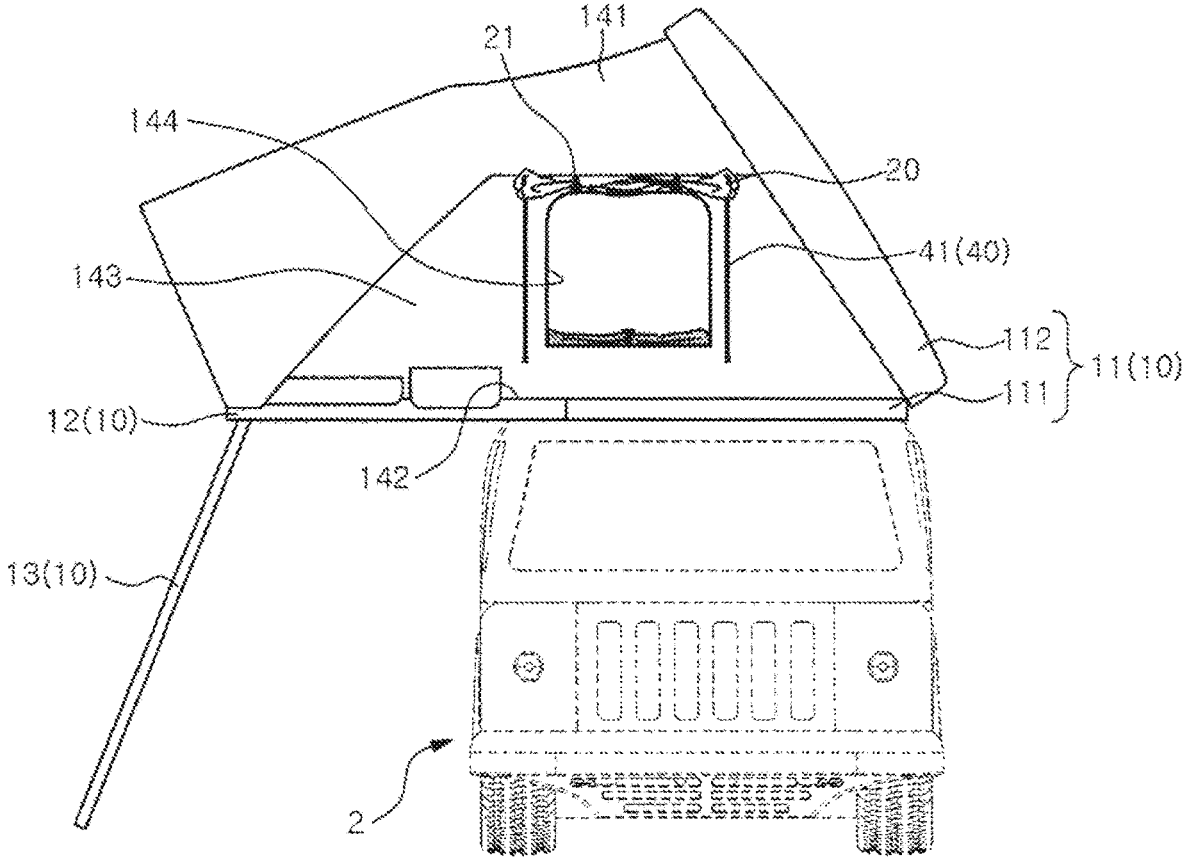
FIG. 2 is a side view of FIG. 1.
Figure 3:
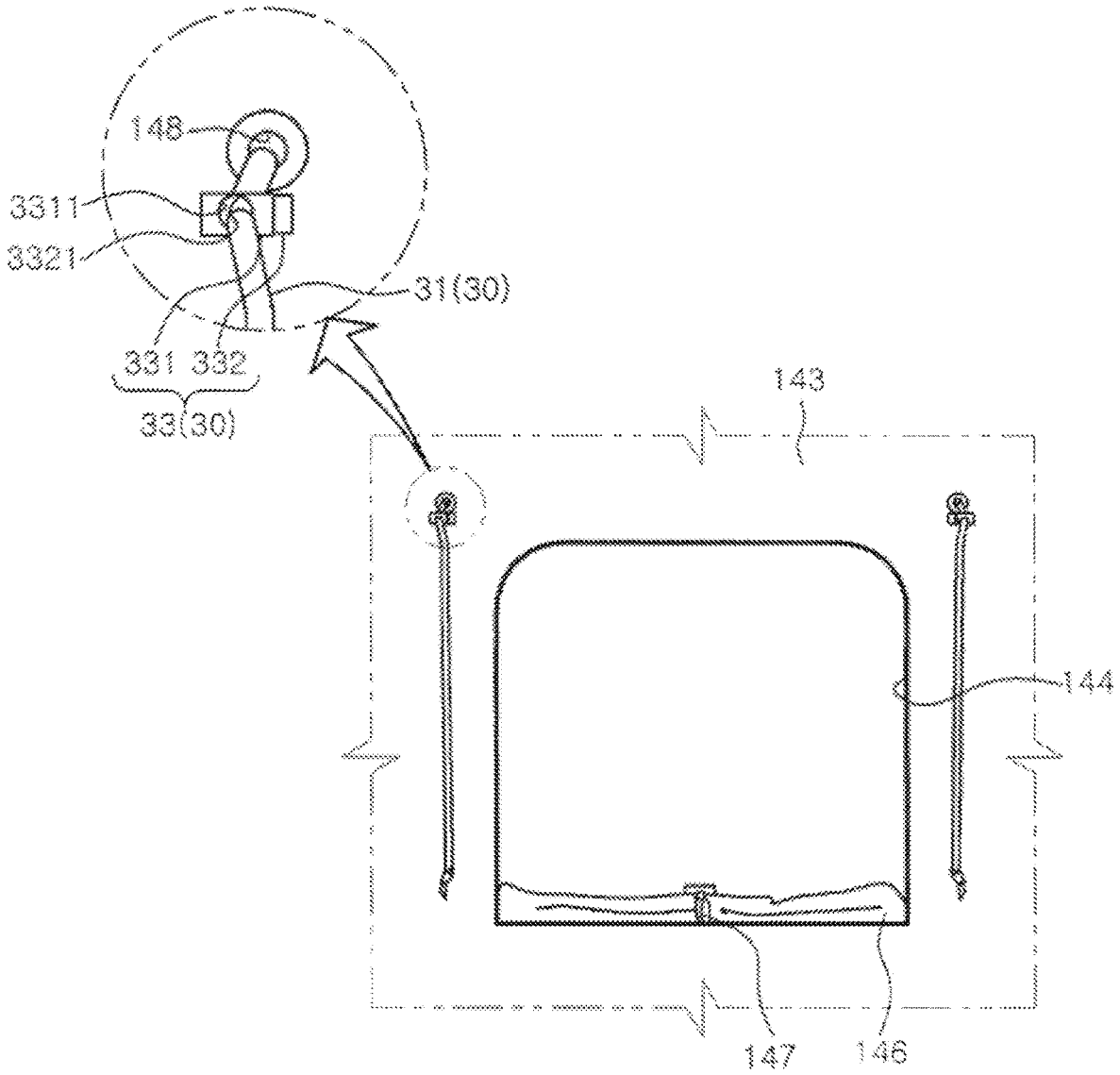
FIG. 3 is a view illustrating an inner surface of a tent member of the rooftop tent in FIG. 2.
Figure 4:
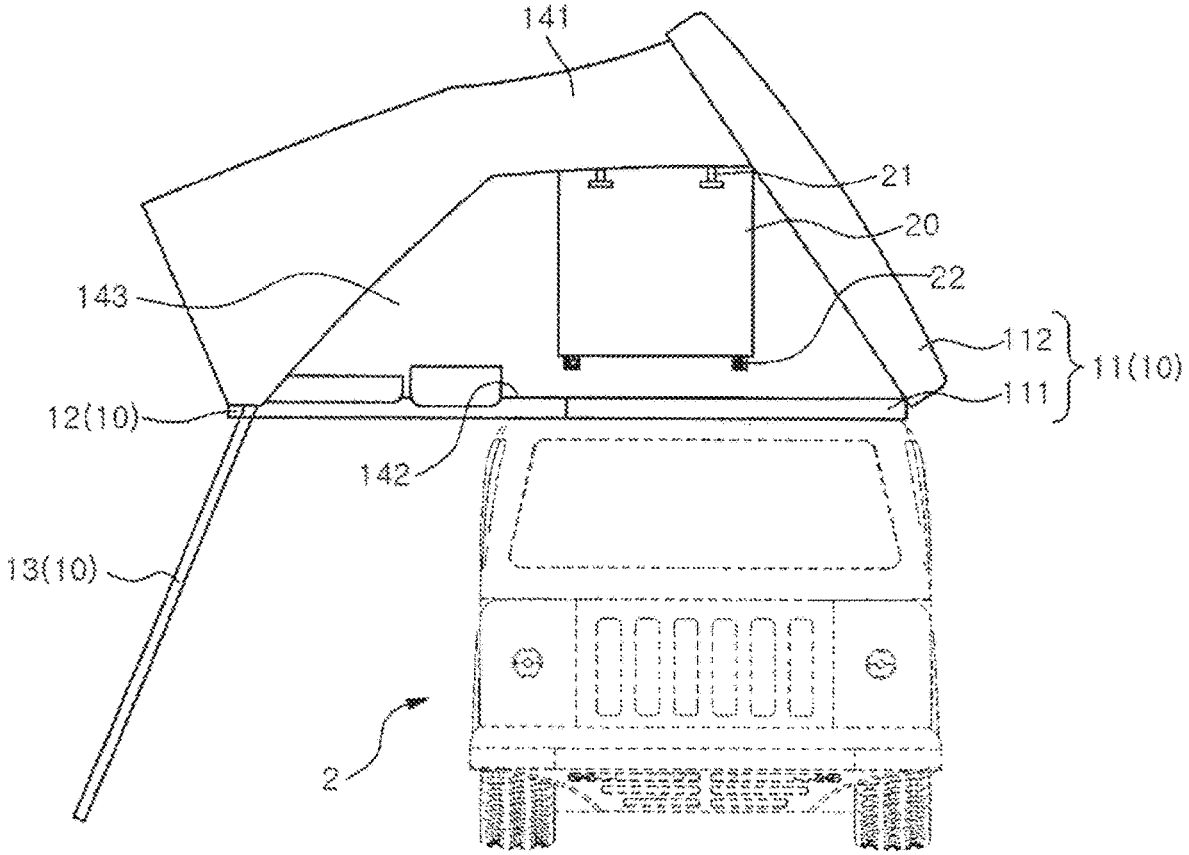
FIG. 4 is a view illustrating a state in which a rotary canopy of the rooftop tent in FIG. 2 is unfolded downward.
Figure 5:
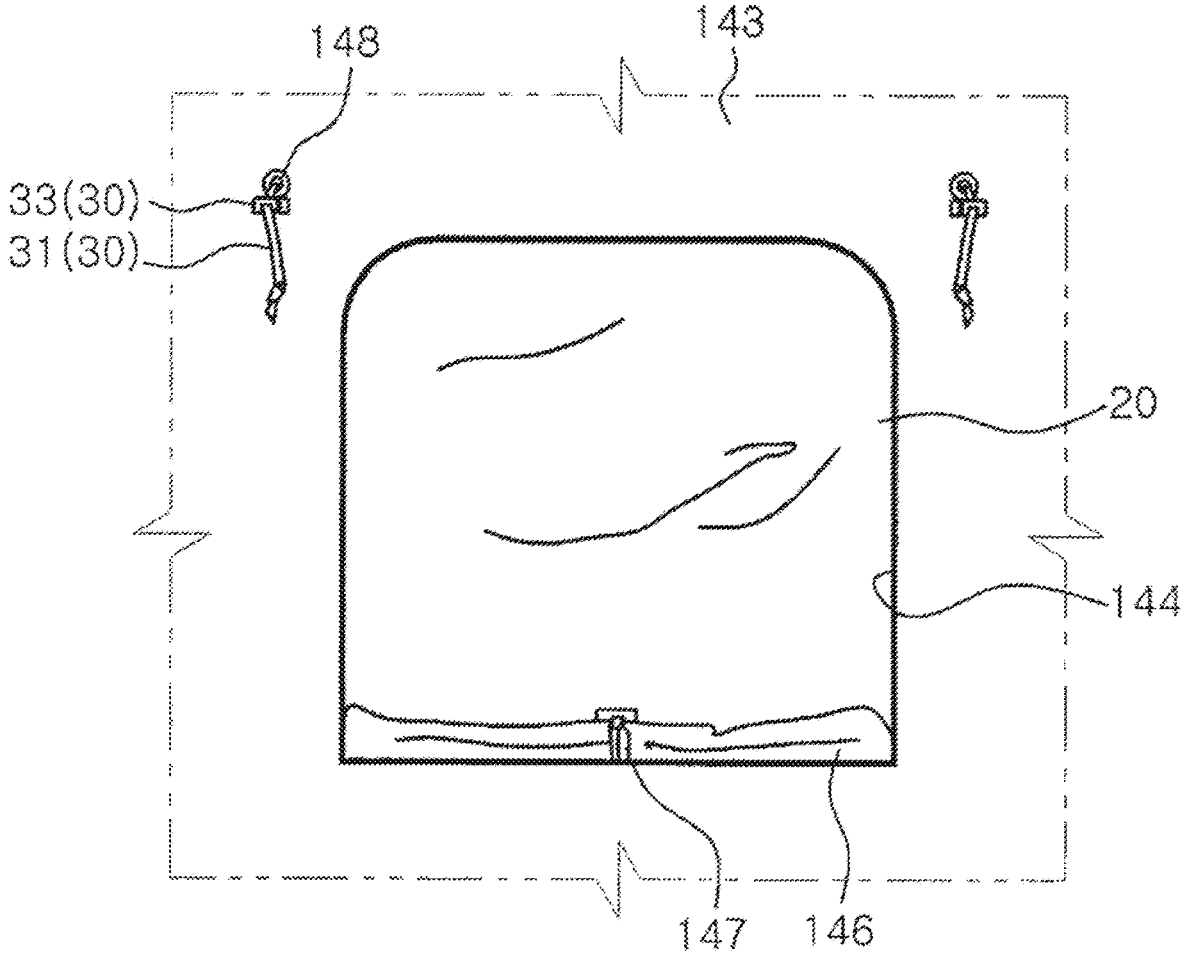
FIG. 5 is a view illustrating the inner surface of the tent member of the rooftop tent in FIG. 4.
Figure 6:
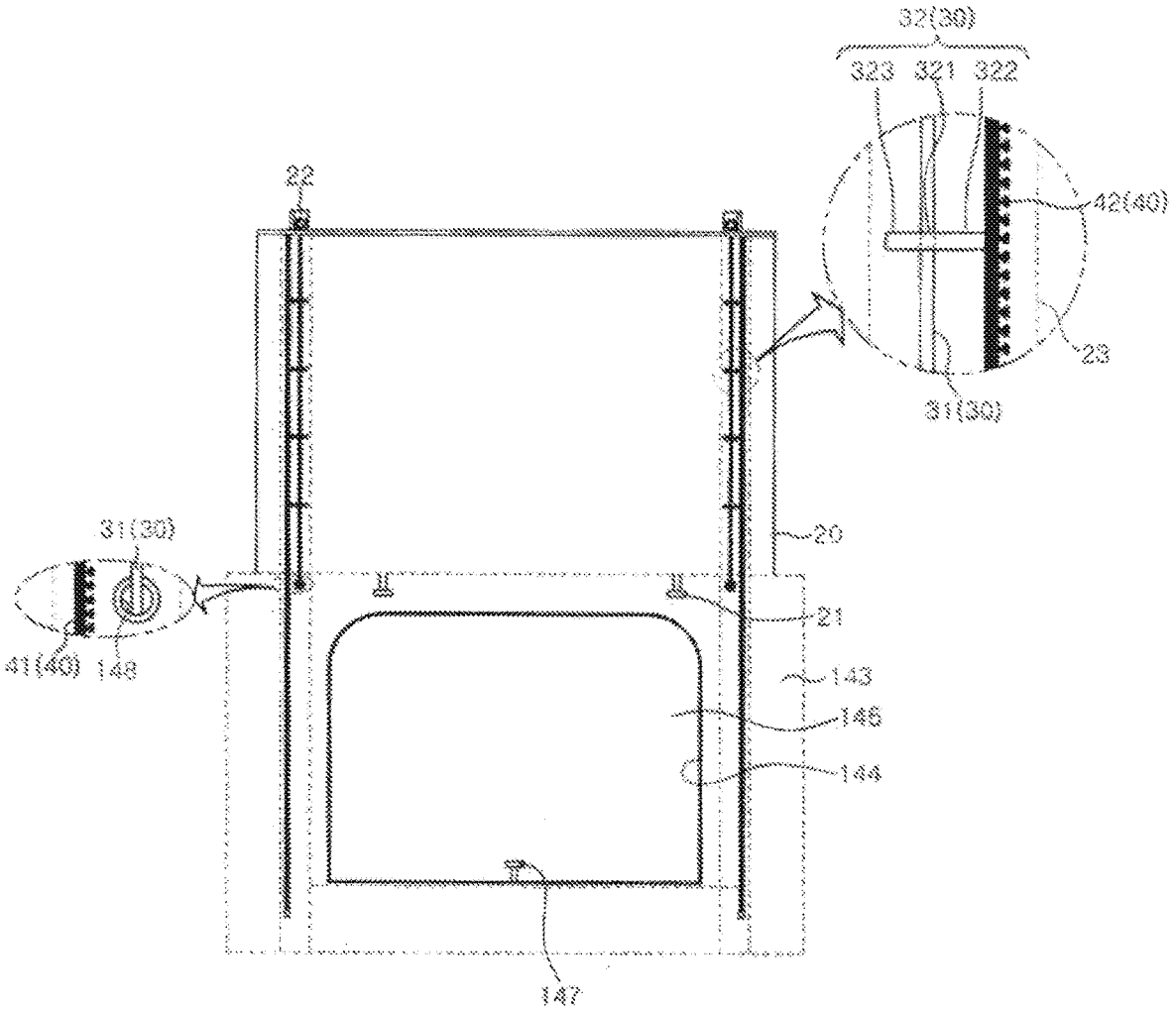
FIG. 6 is a view illustrating a controller in a state in which the rotary canopy of the rooftop tent in FIG. 1 is rotated upward relative to the tent member.

Referring to FIGS. 1 to 6, a rooftop tent 1 according to an embodiment of the present disclosure may include a rooftop tent main body 10, a rotary canopy 20, a controller 30, and a fastener 40.

The rooftop tent main body 10 may be configured to be folded on a roof of a vehicle 2 and stand when being unfolded toward a lateral side of the vehicle 2. The rooftop tent main body 10 may include a hard casing 11, an expansion plate 12, a ladder 13, and a tent member 14.

The hard casing 11 may have an accommodation space that may accommodate the expansion plate 12, the ladder 13, and the tent member 14. To this end, the hard casing 11 may include a base plate 111 detachably fixed to the roof 3 of the vehicle 2, and a cover 112 rotatably connected to the base plate 111 and configured to open or close an upper side of the base plate 111.

The base plate 111 may be manufactured to at least have a length larger than an average height of an adult to ensure a sufficient space in which a user may lie in the tent member 14. In this case, the length of the base plate 111 means a length in a forward/rearward direction of the vehicle 2. In addition, a length of a rim of the base plate 111 is smaller than a length of a rim of the roof 3 of the vehicle 2. Therefore, the entire base plate 111 may be stably supported on the roof 3 of the vehicle 2.

In this case, the base plate 111, together with the cover 112, may define the accommodation space before the rooftop tent 1 is installed. The base plate 111 may serve as a bottom surface of the tent member 14 in the state in which the rooftop tent 1 is installed.

The cover 112, together with the base plate 111, may selectively define the accommodation space. In other words, the cover 112, together with the base plate 111, may define the accommodation space before the rooftop tent 1 is installed. The cover 112 may define a sidewall or ceiling of the tent member 14 in the state in which the rooftop tent 1 is installed.

The cover 112 may be shaped to minimize air resistance when the vehicle 2 travels. For example, a side of the cover 112, which is directed toward a front side of the vehicle 2, may be formed in a streamlined shape. However, this is only an example. A separate device (not illustrated) may be additionally provided to reduce air resistance against the cover 112. For example, the cover 112 may be made of a metallic material such as plastic or aluminum. However, the cover 112 may be made of a hard, lightweight material such as plastic in consideration of the reduction in fuel consumption and the convenience of use.

Meanwhile, a sealing member (not illustrated) such as a rubber packing may be provided on rim portions of the base plate 111 and the cover 112 that come into contact with each other when the cover 112 is closed. Therefore, outside substances such as rainwater do not penetrate between the base plate 111 and the cover 112, such that storage states of the ladder 13 and the tent member 14 accommodated in the base plate 111 and the cover 112 may be maintained. In addition, a locking device (not illustrated) may be additionally provided on each of the base plate 111 and the cover 112.

The expansion plate 12 may be connected to the base plate 111 and be rotatable so that the expansion plate 12 may overlap the base plate 111 or be unfolded from the base plate 111. Therefore, the expansion plate 12 may be accommodated in the accommodation space defined by the base plate 111 and the cover 112 before the rooftop tent 1 is installed. The expansion plate 12, together with the base plate 111, may serve as an expanded bottom surface that may be used by the user in the state in which the rooftop tent 1 is installed. The expansion plate 12 may be supported on the ground surface by the ladder 13.

The ladder 13 allows the expansion plate 12 to overlap the base plate 111 or be unfolded from the base plate 111. To this end, an end of the ladder 13 may be rotatably connected to the expansion plate 12. The ladder 13 may be accommodated in the accommodation space defined by the base plate 111 and the cover 112 before the rooftop tent 1 is installed. In contrast, in the state in which the rooftop tent 1 is installed, the ladder 13 may support the expansion plate 12 on the ground surface and serve as a movement means that the user may use when moving between the ground surface and an internal space of the tent member 14. For example, the ladder 13 may be an extendable sliding ladder, a collapsible ladder, or a ladder having detachable upper and lower parts.

The tent member 14 may be connected to the base plate 111. When the upper side of the base plate 111 is opened as the cover 112 rotates from the base plate 111, the tent member 14 may be unfolded. For example, the tent member 14 may be made of a material such as a fabric having a waterproof function.

The tent member 14 may include an upper surface 141, a lower surface 142, and a lateral surface 143 that connects the upper surface 141 and the lower surface 142. In this case, the lateral surface 143 may be disposed to be perpendicular to the ground surface. In this case, a window 145 and an insect screen 146 may be openably and closably connected to at least one of the upper surface 141, the lower surface 142, and the lateral surface 143 of the tent member 14. The window 145 and the insect screen 146 may be provided to open or close an opening side 144 of the tent member 14. When the rooftop tent is not used, the window 145 and the insect screen 146 may be rolled or folded by the user and then fixed by a separate fixing means 147. Hereinafter, for convenience of description, an example will be described in which the window 145 is provided on the lateral surface 143 of the tent member 14.

A first fastening means 41 of the fastener 40 to be described below or a second fastening means 42 of the fastener 40 to be described below may be provided on at least one side of the window 145. In this case, the first fastening means 41 or the second fastening means 42 may extend in an upward/downward direction. The first fastening means 41 or the second fastening means 42 may be fastened to a second fastening means 42 or a first fastening means 41 provided on the rotary canopy 20 to be described below, such that the window 145 may be selectively covered by the rotary canopy 20.

Meanwhile, the tent member 14 may have through-holes 148 through which control ropes 31 of the controller 30 to be described below may pass. The through-holes 148 may be disposed at an upper end of the lateral surface 143 of the tent member 14 and provided at positions corresponding to rotary canopy side passageways 23 provided in the rotary canopy 20 to be described below. In this case, because the lateral surface 143 of the tent member 14 may be disposed to be perpendicular to the ground surface, the control rope 31 having passed through the through-hole 148 may be disposed substantially in parallel with the lateral surface 143 of the tent member 14.

The rotary canopy 20 may serve as a sun shelter for forming a shade outside the window 145 provided on the tent member 14 or serve as a curtain for the window 145. To this end, the rotary canopy 20 may be rotatably connected to at least one of the upper surface 141, the lower surface 142, and the lateral surface 143 of the tent member 14.

First, the configuration in which the rotary canopy 20 serves as a sun shelter will be described. The rotary canopy 20 may be rotated upward relative to the lateral surface 143 of the tent member 14 and then fixed by a rotary canopy fixing means 21. In this case, the rotary canopy 20, which is rotated upward relative to the tent member 14, may be fixed by means of a separate tension bar (not illustrated). For example, one end of the tension bar is inserted into an insertion port (not illustrated) provided in the tent member 14, and the other end of the tension bar is inserted into an insertion port 22 of the rotary canopy 20, such that the state in which the rotary canopy 20 is rotated upward relative to the tent member 14 may be maintained. In this case, the rotary canopy 20 may form a shade by being disposed to define a predetermined inclination with respect to the lateral surface 143 of the tent member 14.

Next, the configuration in which the rotary canopy 20 serves as a curtain will be described. When the tension bar is separated from the rotary canopy 20 rotated upward relative to the lateral surface 143 of the tent member 14, the rotary canopy 20, which is rotated upward relative to the lateral surface 143 of the tent member 14, is unfolded downward. The rotary canopy 20, which is rotated downward and unfolded, covers the window 145 from the outside of the window 145, such that the rotary canopy 20 may serve as a curtain for the window 145.

Meanwhile, when either of the sun shelter function and the curtain function of the rotary canopy 20 is not required, the rotary canopy 20 may be folded upward and stored by the controller 30.

The controller 30 may fold the rotary canopy 20 upward so that portions of the rotary canopy 20 overlap one another. To this end, the controller 30 may include the control ropes 31, connection members 32, and stoppers 33.

The control rope 31 may receive an external force applied by the user to fold the rotary canopy 20 upward and transmit the external force to the rotary canopy 20. To this end, the control rope 31 may extend in one direction, and at least a part of the control rope 31 may be disposed at one side of any one of the first fastening means 41 of the fastener 40 to be described below and the second fastening means 42 of the fastener 40 to be described below.

In this case, at least a part of the control rope 31 may be movably inserted into the rotary canopy side passageway 23 provided in the rotary canopy 20, and the remaining part of the control rope 31 may pass through the through-hole 148 provided in the tent member 14 may be exposed in the tent member 14. In other words, one end of the control rope 31 is fixed to the rotary canopy 20 while being disposed in the rotary canopy side passageway 23 provided in the rotary canopy 20, such that one end of the control rope 31 may serve as a fixing point. In addition, the other end of the control rope 31 is exposed in the tent member 14 through the through-hole 148 provided in the tent member 14, such that the other end of the control rope 31 may be held by the user.

The connection member 32 may be configured to come into contact with the rotary canopy 20 that moves in a direction of an external force when the external force is applied to the control rope 31. When the rotary canopy 20 is moved upward and comes into contact with the connection member 32 by the external force applied to the control rope 31, the rotary canopy 20 does not move upward any further, but the portions of the rotary canopy 20 may overlap one another between the connection members 32. In other words, a width of the rotary canopy 20 disposed between the two adjacent connection members 32 may vary depending on the external force applied to the control rope 31 exposed in the tent member 14. Therefore, a degree to which the portions of the rotary canopy 20 overlap one another may be determined depending on the number of provided in the rotary canopy side connection members 32 passageway 23.

In this case, the connection member 32 may be provided in the rotary canopy side passageway 23 provided in the rotary canopy 20. The connection member 32 may be disposed in a direction perpendicular to one direction and connect at least a part of the control rope 31 to any one of the first fastening means 41 of the fastener 40 to be described below and the second fastening means 42 of the fastener 40 to be described below.

Meanwhile, the connection member 32 may include: a movement insertion portion 321 into which the control rope 31 is movably inserted; a first fixing portion 322 connected to one side of the movement insertion portion 321 and fixed to an inner surface of the rotary canopy 20; and a second fixing portion 323 connected to the other side of the movement insertion portion 321 and fixed to the inner surface of the rotary canopy 20. In this case, any one of the first fixing portion 322 and the second fixing portion 323 may be fixed to the first fastening means 41 or the second fastening means 42 of the fastener 40 to be described below.

The stopper 33 may maintain the folded state in which the portions of the rotary canopy 20 overlap one another. To this end, the stopper 33 may be movably connected to the other end of the control rope 31 exposed in the tent member 14.

The stopper 33 may include: an insertion body 331 having therein an elastic member (not illustrated) and having a first insertion hole 3311 into which the control rope 31 is penetratively inserted; and a movement body 332 movably coupled to the insertion body 331 and having a second insertion hole 3321 configured to selectively communicate with the first insertion hole 3311, the movement body 332 being configured to selectively press the elastic member.

In this case, when the movement body 332 is pressed by an external force applied from the outside, the movement body 332 is inserted into the insertion body 331, and the second insertion hole 3321 of the movement body 332 communicates with the first insertion hole 3311 of the insertion body 331. When the first insertion hole 3311 and the second insertion hole 3321 communicate with each other, the insertion body 331 may move along the control rope 31 penetratively inserted into the first insertion hole 3311. When the position of the insertion body 331 with respect to the control rope 31 is completely selected, the external force applied to the movement body 332 is eliminated. When the external force applied to the movement body 332 is eliminated, the movement body 332 is withdrawn from the insertion body 331 by an elastic restoring force of the elastic member. In this process, the first insertion hole 3311 and the second insertion hole 3321 are not aligned with each other, and the control rope 31 interferes with an inner peripheral surface of the second insertion hole 3321, such that the insertion body 331 cannot move along the control rope 31 any further.

The fastener 40 may selectively fasten the rotary canopy 20 to the tent member 14. To this end, the fastener 40 may include: the first fastening means 41 provided on any one of an outer surface of the tent member 14 and an inner surface of the rotary canopy 20 and extending in one direction; and the second fastening means 42 provided on the other of the outer surface of the tent member 14 and the inner surface of the rotary canopy 20 and extending in one direction, the second fastening means 42 being configured to selectively engage with the first fastening means 41.

In this case, the first fastening means 41 may be provided as a pair of first fastening means 41, the second fastening means 42 may be provided as a pair of second fastening means 42, and the pair of first fastening means 41 and the pair of second fastening means 42 may be disposed to face one another. For example, the first fastening means 41 may be configured as a female zipper, and the second fastening means 42 may be configured as a male zipper.

Figure 7:
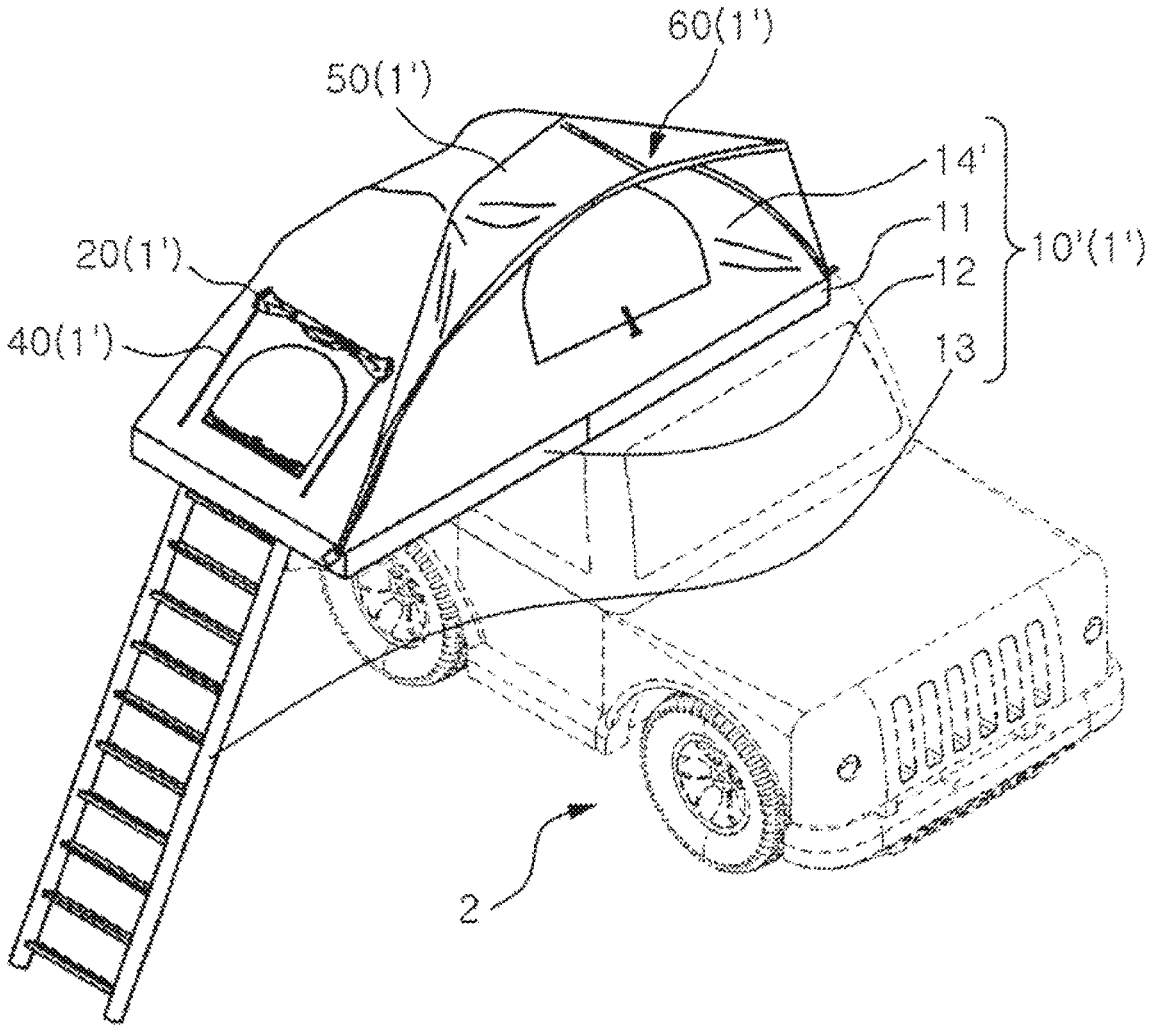
FIG. 7 is a perspective view illustrating a rooftop tent according to another embodiment of the present disclosure.
Figure 8:
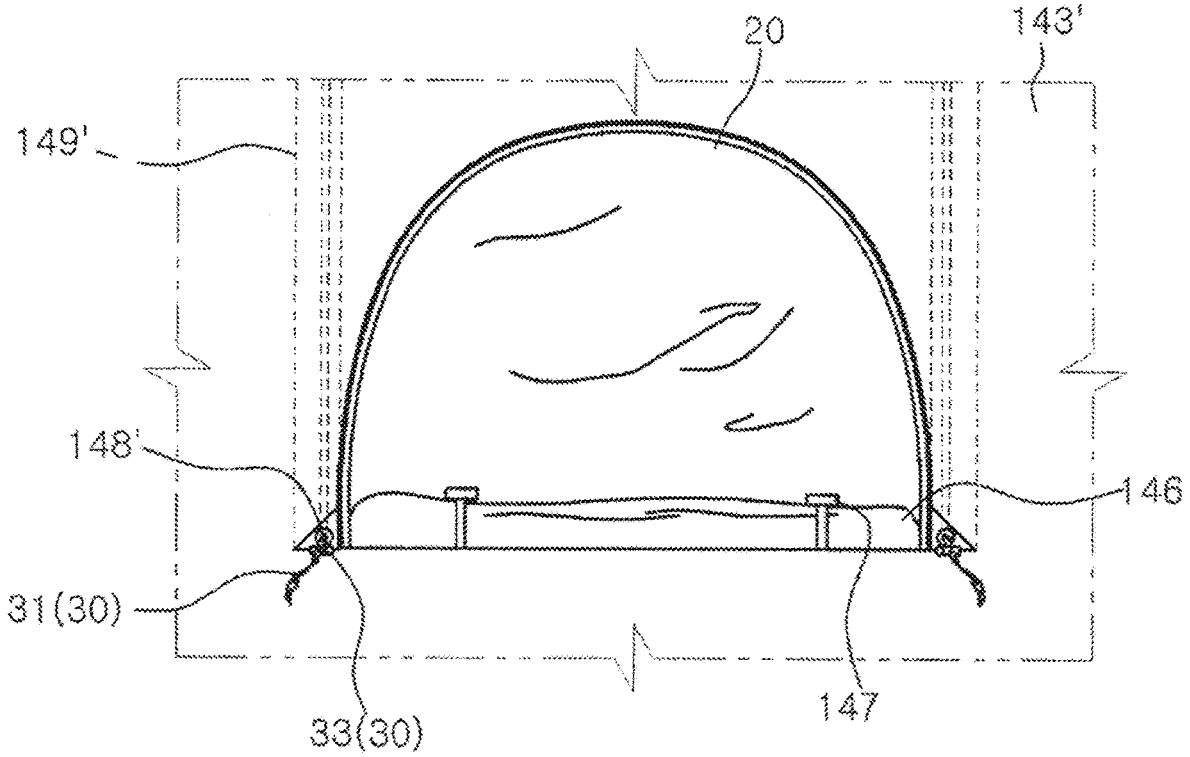
FIG. 8 is a view illustrating an inner surface of a tent member in a state in which a rotary canopy of the rooftop tent in FIG. 7 is unfolded downward.
Figure 9:
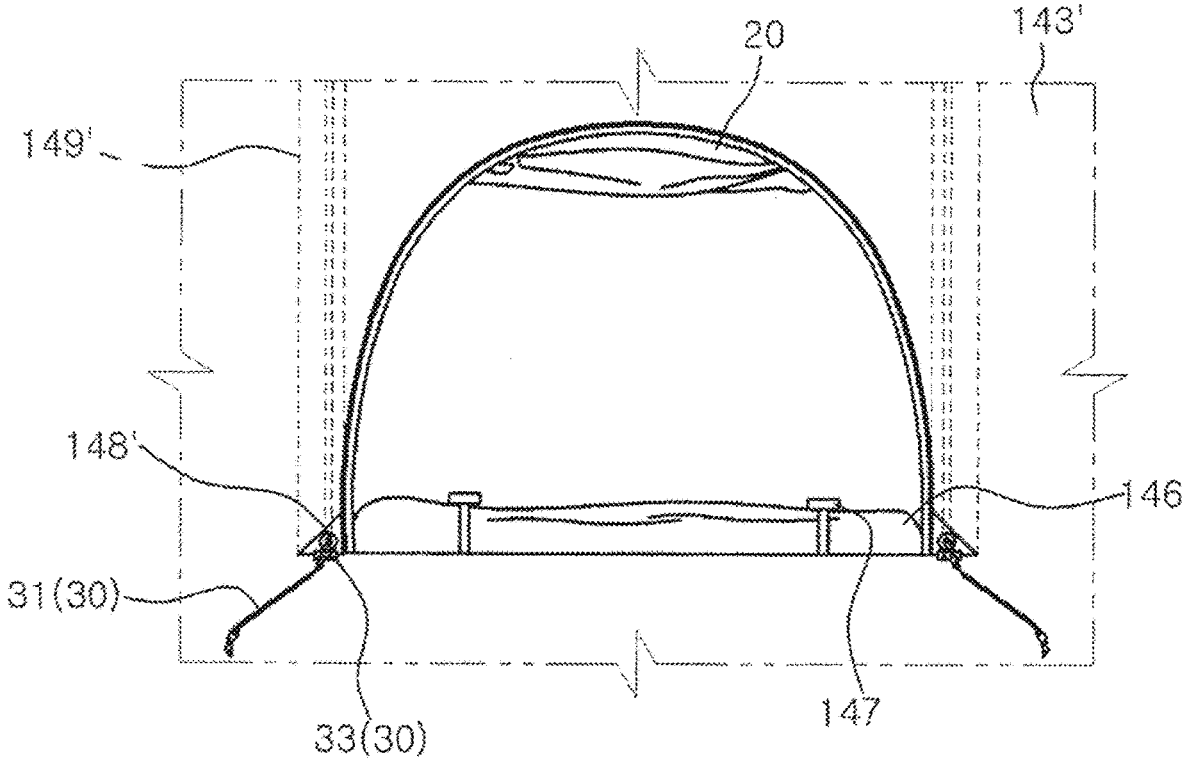
FIG. 9 is a view illustrating the inner surface of the tent member in a state in which the rotary canopy of the rooftop tent in FIG. 7 is folded upward.
Figure 10:
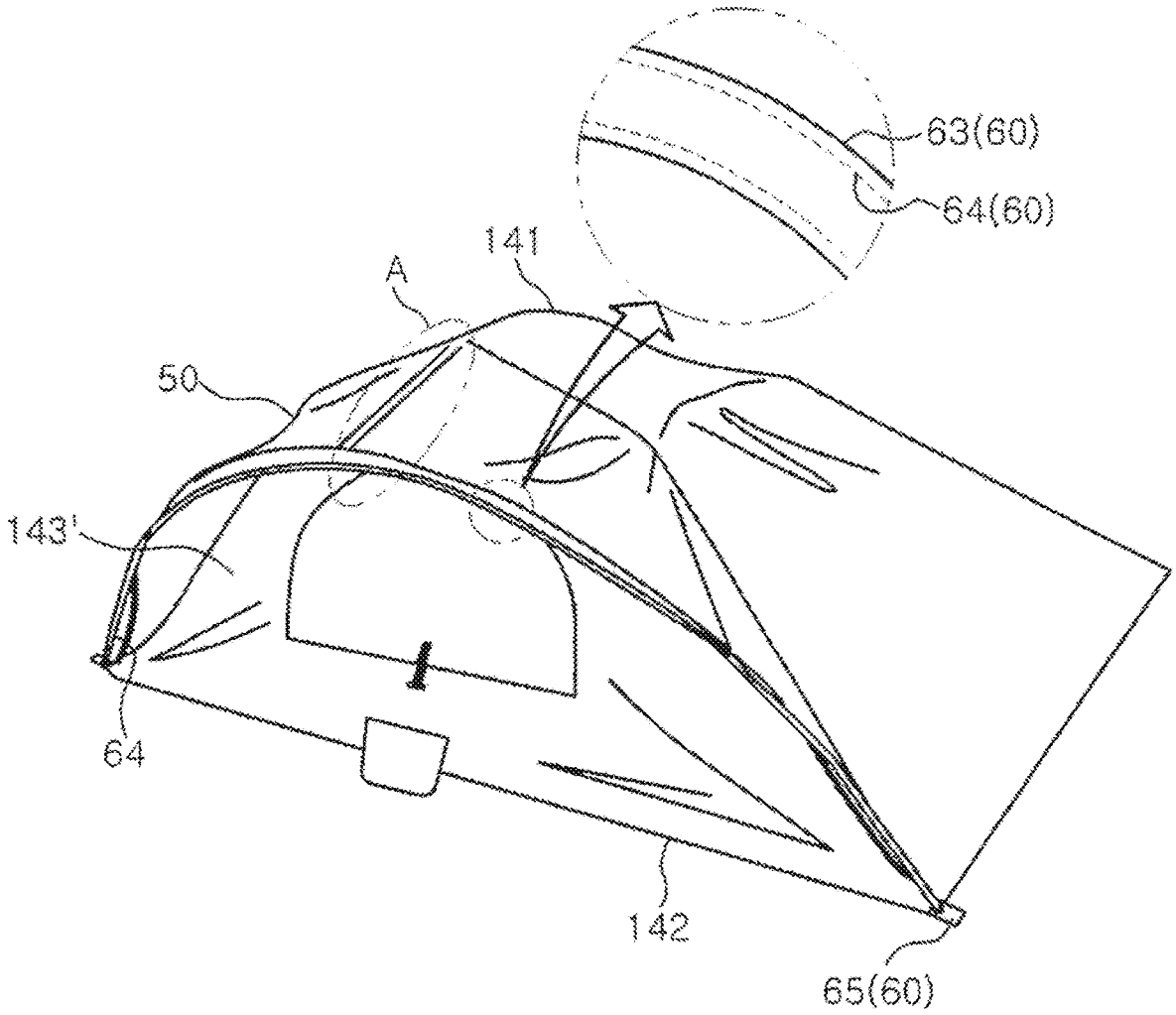
FIG. 10 is a perspective view illustrating a reinforcing support part of the rooftop tent in FIG. 7.
Figure 11:
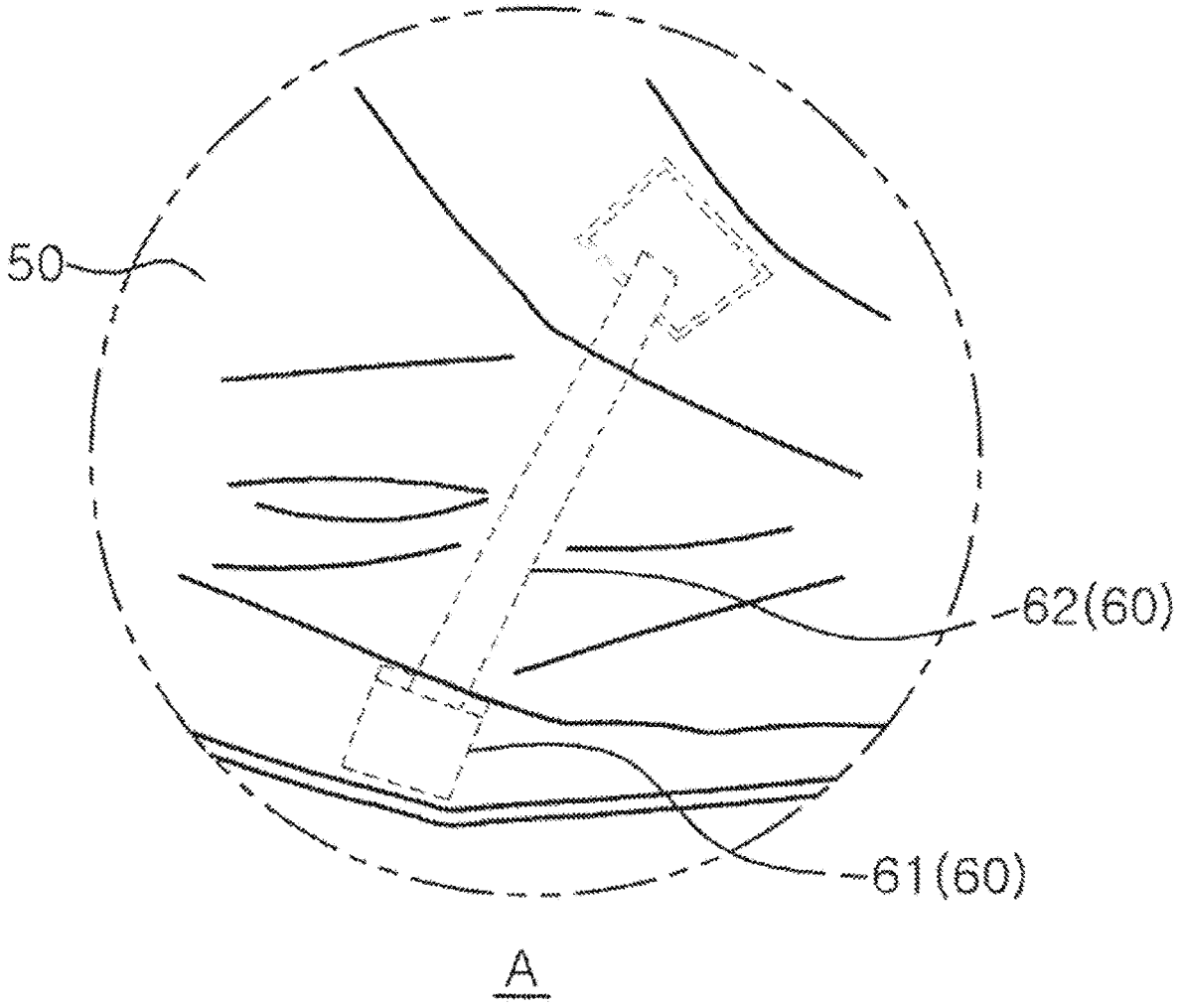
FIG. 11 is an enlarged view of part A in FIG. 10.

Hereinafter, a rooftop tent according to another embodiment of the present disclosure will be described with reference to FIGS. 7 to 11.

Referring to FIGS. 7 to 11, a rooftop tent 1' according to another embodiment of the present disclosure may include a rooftop tent main body 10', a rotary canopy 20, a controller 30, a fastener 40, a fixed canopy 50, and a reinforcing support part 60. In this case, the rooftop tent 1' illustrated in FIGS. 7 to 11 is substantially identical to the rooftop tent 1 described with reference to FIGS. 1 to 6, except for the rooftop tent main body 10', the fixed canopy 50, and the reinforcing support part 60. Therefore, the description will be focused on the rooftop tent main body 10', the fixed canopy 50, and the reinforcing support part 60 that are the differences, and the above-mentioned description of the embodiment and the reference numerals will be applied to the same constituent elements.

The rooftop tent main body 10' may be configured to be folded on the roof of the vehicle 2 and stand when being unfolded toward the lateral side of the vehicle 2. The rooftop tent main body 10' may include a hard casing 11, an expansion plate 12, a ladder 13, and a tent member 14'. However, because the hard casing 11, the expansion plate 12, and the ladder 13 have been described with reference to FIGS. 1 to 6, the description will be focused on the tent member 14' that is the difference.

The tent member 14' may be connected to the base plate 111. When the upper side of the base plate 111 is opened as the cover 112 rotates from the base plate 111, the tent member 14' may be unfolded. For example, the tent member 14' may be made of a material such as a fabric having a waterproof function.

The tent member 14' may include an upper surface 141, a lower surface 142, and a lateral surface 143' that connects the upper surface 141 and the lower surface 142. In this case, the lateral surface 143' may be disposed to be inclined with respect to the ground surface.

Meanwhile, the tent member 14' may have through-holes 148' through which control ropes 31 of the controller 30 to be described below may pass. In addition, the tent member 14' may have a tent member side passageway 149' corresponding to the rotary canopy side passageway 23 of the rotary canopy 20. In this case, the tent member side passageway 149' may extend in the upward/downward direction. The through-hole 148' may communicate with the tent member side passageway 149'.

The through-hole 148' may communicate with the tent member side passageway 149' corresponding to a lower end of the lateral surface 143' of the tent member 14'. In this case, because the lower end of the lateral surface 143' of the tent member 14' is disposed to be further substantially perpendicular to the ground surface than an upper end of the lateral surface 143' of the tent member 14', the control rope 31 having passed through the through-hole 148' may be disposed to be substantially in parallel with the lateral surface 143' of the tent member 14' even though the lateral surface 143' of the tent member 14' is disposed to be inclined at a predetermined angle with respect to the ground surface.

The fixed canopy 50 may be connected to a boundary between the upper surface 141 and the lateral surface 143' of the tent member 14' and form a shade. The fixed canopy 50 may form the shade by being selectively unfolded from the boundary between the upper surface 141 and the lateral surface 143' of the tent member 14'. The state in which the fixed canopy 50 is unfolded may be maintained by the separate reinforcing support part 60 provided on the fixed canopy 50.

The reinforcing support part 60 may include: a first fixing means 61 provided on an inner surface of the fixed canopy 50; and a first reinforcing support member 62 having one end fixed to at least one of the tent member 14 and the fixed canopy 50, and the other end selectively inserted and accommodated in the first fixing means 61.

In this case, the first fixing means 61 may be a pocket having an opening opened at one side. An inner surface of the first fixing means 61 may have a shape corresponding to a shape of the other end of the first reinforcing support member 62.

The first reinforcing support member 62 may have a length substantially equal to a distance between a periphery of the fixed canopy 50 and the boundary between the upper surface 141 and the lateral surface 143' of the tent member 14'. For example, the first reinforcing support member 62 may be made of a flexible material so as to be easily inserted into the first fixing means 61 and easily separated from the first fixing means 61. The first reinforcing support member 62 may be made of a material having predetermined tension to maintain the state in which the fixed canopy 50 is unfolded.

In addition, the reinforcing support part 60 may further include: a second fixing means 63 provided along at least a part of the periphery of the fixed canopy 50; a second reinforcing support member 64 selectively fixedly inserted into the second fixing means 63; and a third fixing means 65 provided on at least one of the tent member 14 and the fixed canopy 50 and configured such that an end of the second reinforcing support member 64 is fixedly inserted into the third fixing means 65.

The second fixing means 63 is a portion provided on at least a part of the periphery of the fixed canopy 50 to insert the second reinforcing support member 64. The second fixing means 63 may be provided in a cylindrical shape that may surround the second reinforcing support member 64. In this case, two opposite ends of the second fixing means 63 may be opened. The second reinforcing support member 64, for example, a pole having predetermined tension may be inserted or separated through the opened end of the second fixing means 63.

In this case, a length of the second fixing means 63 is shorter than a length of the second reinforcing support member 64, such that two opposite ends of the second reinforcing support member 64 inserted into the second fixing means 63 may be exposed from the second fixing means 63. The two opposite ends of the second reinforcing support member 64 exposed from the second fixing means 63 are inserted into the third fixing means 65 provided on at least one of the tent member 14' and the fixed canopy 50, and the second reinforcing support member 64 defines an arcuate shape, such that the state in which the fixed canopy 50 is unfolded may be maintained.

While the embodiments of the present disclosure have been described above as specific embodiments, the embodiments of the present disclosure are for illustrative purposes only, and the present disclosure is not limited thereto. The present disclosure should be interpreted as having the widest scope defined by the basic spirit disclosed in the present specification. Those skilled in the art may combine/substitute the disclosed embodiments to perform patterns with unspecified shapes, but this does not depart from the scope of the present disclosure. In addition, it is apparent that those skilled in the art may easily change or modify the embodiment disclosed) based on the present specification, and such changes or modifications also belong to the protection scope of the present disclosure.

What is claimed is:

1. A rooftop tent comprising:

a rooftop tent main body comprising a tent member configured to be folded on a roof of a vehicle and stand when being unfolded toward a lateral side of the vehicle;

a rotary canopy rotatably connected to the tent member;

a controller connected to the tent member and the rotary canopy and configured to fold the rotary canopy upward so that portions of the rotary canopy overlap one another; and a fastener configured to selectively fasten the rotary canopy to the tent member;

wherein the fastener comprises:

a first fastening means provided on any one of an outer surface of the tent member and an inner surface of the rotary canopy and extending in one direction; and a second fastening means provided on the other of the outer surface of the tent member and the inner surface of the rotary canopy and extending in one direction, the second fastening means being configured to selectively engage with the first fastening means;

wherein the controller comprises:

a control rope extending in one direction and having at least a part disposed at one side of any one of the first fastening means and the second fastening means; and a connection member disposed in a direction perpendicular to one direction and configured to connect at least a part of the control rope to any one of the first fastening means and the second fastening means; and wherein the remaining part of the control rope is exposed in the tent member.

2. The rooftop tent of claim 1, wherein the connection member comprises:

a movement insertion portion into which the control rope is movably inserted;

a first fixing portion connected to one side of the movement insertion portion and fixed to an inner surface of the rotary canopy; and a second fixing portion connected to the other side of the movement insertion portion and fixed to the inner surface of the rotary canopy, and wherein an end of any one of the first fixing portion and the second fixing portion is connected to any one of the first fastening means and the second fastening means.

3. The rooftop tent of claim 1, wherein the controller further comprises a stopper movably connected to the remaining part of the control rope exposed in the tent member.

4. The rooftop tent of claim 3, wherein the stopper comprises:

an insertion body having an elastic member therein and having a first insertion hole into which the control rope is penetratively inserted; and a movement body movably coupled to the insertion body and having a second insertion hole configured to selectively communicate with the first insertion hole, and the movement body being configured to selectively press the elastic member.

5. The rooftop tent of claim 1, wherein the rotary canopy has at least one rotary canopy side passageway extending in an upward/downward direction, and at least a part of the control rope is movably disposed in the rotary canopy side passageway.

6. The rooftop tent of claim 5, wherein the tent member has a through-hole through which the remaining part of the control rope passes.

7. The rooftop tent of claim 1, wherein the connection member is provided as a plurality of connection members, and a width of the rotary canopy, which is disposed between two adjacent connection members among the plurality of the connection member, is changed by an external force applied to the control rope exposed in the tent member.

8. The rooftop tent of claim 1, further comprising:

a fixed canopy provided on the tent member.

9. The rooftop tent of claim 8, further comprising:

a reinforcing support part provided on the fixed canopy.

10. The rooftop tent of claim 9, wherein the reinforcing support part comprises:

a first fixing means provided on an inner surface of the fixed canopy; and a first reinforcing support member having one end fixed to at least one of the tent member and the fixed canopy, and the other end selectively inserted and accommodated in the first fixing means.

11. The rooftop tent of claim 9, wherein the reinforcing support part further comprises:

a second fixing means provided along at least a part of a periphery of the fixed canopy;

a second reinforcing support member selectively inserted and fixed into the second fixing means; and a third fixing means provided on at least one of the tent member and the fixed canopy and configured such that an end of the second reinforcing support member is fixedly inserted into the third fixing mean.

* * * * *